US007098596B2

(12) United States Patent
Takagaki et al.

(10) Patent No.: US 7,098,596 B2
(45) Date of Patent: Aug. 29, 2006

(54) MERCURY-FREE ARC TUBE FOR DISCHARGE LAMP UNIT

(75) Inventors: Michio Takagaki, Shizuoka (JP); Masaya Shido, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 157 days.

(21) Appl. No.: 10/717,896

(22) Filed: Nov. 21, 2003

(65) Prior Publication Data

US 2004/0150344 A1 Aug. 5, 2004

(30) Foreign Application Priority Data

Nov. 22, 2002 (JP) ..... P.2002-339327

(51) Int. Cl.
*H01J 61/73* (2006.01)

(52) U.S. Cl. ..... 313/631; 313/357

(58) Field of Classification Search ..... 313/638, 313/637, 634, 643, 641, 620, 639, 25, 17, 313/246, 361, 357

See application file for complete search history.

(56) References Cited

U.S. PATENT DOCUMENTS

| | | | | |
|---|---|---|---|---|
| 4,594,529 | A | 6/1986 | De Vrijer | |
| 4,949,003 | A * | 8/1990 | Cox et al. | 313/25 |
| 4,992,700 | A * | 2/1991 | Lake | 313/639 |
| 5,239,230 | A * | 8/1993 | Mathews et al. | 313/571 |
| 5,402,037 | A | 3/1995 | Irisawa et al. | |
| 5,486,737 | A * | 1/1996 | Hrubowchak et al. | 313/634 |
| 6,265,827 | B1 * | 7/2001 | Takahashi et al. | 313/638 |
| 6,274,973 | B1 * | 8/2001 | Mochiduki et al. | 313/318.09 |
| 6,294,861 | B1 | 9/2001 | Mochiduki et al. | |
| 6,353,289 | B1 * | 3/2002 | Ishigami et al. | 313/637 |
| 6,774,566 | B1 * | 8/2004 | Honda et al. | 313/634 |
| 2002/0047611 | A1 * | 4/2002 | Kaneko et al. | 315/246 |
| 2002/0070668 | A1 * | 6/2002 | Eastlund et al. | 313/634 |
| 2003/0189408 | A1 * | 10/2003 | Lapatovich et al. | 313/637 |

FOREIGN PATENT DOCUMENTS

JP 2003-168391 A 6/2003

* cited by examiner

*Primary Examiner*—Ashok Patel
*Assistant Examiner*—Christopher M. Raabe
(74) *Attorney, Agent, or Firm*—Sughrue Mion, PLLC

(57) ABSTRACT

An arc tube for a discharge bulb is provided for use in a vehicular lighting system. The arc tube includes a closed glass bulb that is pinch-sealed at opposite ends. Inner ends of a first electrode and a second electrode extend into the closed glass bulbs from the ends of the closed glass bulb. The atmosphere inside the closed glass bulb includes a starting rare gas, a primary light-emitting metal halide, and optionally, a buffer metal halide. The distance between the inner ends of the electrodes is between about 0.3 and 1.8, and the inner diameter of the closed glass bulb at a middle portion is between about 1.5 mm and 2.7 mm. Accordingly, a stable discharge is produced using between 15 W and 30 W of power.

3 Claims, 3 Drawing Sheets

MERCURY-FREE ARC TUBE FOR DISCHARGE LAMP UNIT

BACKGROUND OF THE INVENTION

1. Field of the Invention

The present invention relates to an arc tube for a discharge lamp unit having a closed glass bulb in which a pair of electrodes are disposed, and a pinch seal on both sides of the closed glass bulb. In particular, the present invention relates to a mercury-free arc tube for a low-voltage discharge lamp unit having a closed glass bulb filled with a primary light-emitting metal halide, an optional buffer metal halide, and a starting rare gas.

2. Background of the Related Art

FIG. 3 illustrates a related art discharge bulb used in a discharge lamp unit as a light source of vehicular lamps. The related art discharge bulb includes an arc tube 2 containing a closed glass bulb 2*a* (or a light emitting portion) formed integrally with a resin insulating plug body 1. The rear end of the arc tube 2 is supported by a metal support 8 that is fixed to the insulating plug body 1, and the front end of the arc tube 2 is supported by a metal lead support 9 that extends from the insulating plug body 1 and serves as a current path.

The arc tube 2 is pinch-sealed at both ends by pinch seals 2*b*. The closed glass bulb 2*a* has opposing electrodes 3 extending into the ends of the closed glass bulb of the arc tube 2, which is filled with a metal halide as a primary light-emitting substance, mercury as a buffer gas, and a rare gas as a starting gas.

Mercury in the arc tube is the buffer for maintaining a prescribed tube voltage and buffering (i.e., reducing electron collision against the electrodes) to reduce electrode damage. Mercury is also an auxiliary light-emitting substance for generating white light.

In the related art discharge bulb, light is emitted from an arc discharge created between the electrodes 3. Since arc tubes produce more light and have a longer service life than incandescent lamps, they are being increasingly used as a light source of headlights or fog lights.

In the related art discharge bulb illustrated in FIG. 3, a lead wire 4 is located at an end of the pinch seal 2*b*. A pinch-sealed molybdenum foil 5 is connected between a lead wire 4 and a tungsten electrode 3. The arc tube 2 is integrally welded to a glass shroud 6 that provides ultraviolet shielding and creates a closed space that includes the foregoing elements. The glass shroud 6 blocks ultraviolet rays in a wavelength range harmful to human body from being emitted by the arc tube 2, and keeps the glass bulb 2*a* at a high temperature.

However, the foregoing related art discharge bulb has various problems and disadvantages. Because the related art closed glass bulb 2*a* contains mercury as a buffer gas, the related art mercury discharge bulb is harmful to the environment. To overcome the foregoing problem and meet the recent social demand for reduction of environmental pollutants, there has been a need to develop an arc tube containing no environmentally harmful mercury, namely a mercury-free arc tube.

Unfortunately, the foregoing related art bulb could not exclude mercury for at least the following reasons. For example, but not by way of limitation, excluding mercury from the closed glass bulb would reduce tube voltage and require an increased electrical current for maintaining the tube voltage. As a result, there would be an increased load on the electrodes, leading to a reduction in luminous efficiency. Elimination of mercury from the closed glass bulb 2*a* also prevents generation of light having a desired chromaticity.

To overcome at least the foregoing related art problems, applicants used a metal halide that acts as a buffer in place of mercury and realizes the same chromaticity as the foregoing related art mercury-containing arc tubes, to create a mercury-free arc tube exhibiting similar characteristics to those of the mercury-containing arc tubes, with no alterations to the shape and dimensions. This mercury-free arc tube includes a closed glass bulb filled with a primary light-emitting metal halide, together with the selected buffer metal halide and a starting rare gas. The pressure of the rare gas is about 8 to 20 atm, which is higher than in the related art mercury-containing arc tubes (3 to 6 atm). Applicants filed Japanese Patent Application No. 2001-286252, the contents of which is incorporated herein by reference.

A further modification of the foregoing mercury-free arc tube produced characteristics similar to those of related art arc tubes with no buffer metal halide sealed into the closed glass bulb. The total amount and proportion of a prescribed primary light-emitting metal halide and the pressure of the starting rare gas (about 8 to 20 atm) sealed into the closed glass bulb was maintained. Based on this modification, applicants filed Japanese patent Application No. 2002-243489 (not prior art), the contents of which is incorporated herein by reference, claiming priority to the above-noted Japanese Patent Application No. 2001-286252.

The mercury-free arc tube of JPA 2002-243489 has similar characteristics to related art mercury-containing arc tubes, and a power consumption of about 35 W, which is the same as the related art mercury-containing arc tubes.

However, users demand a reduction in the energy required to operate discharge bulbs (arc tubes). Also, the number of electric parts and accessories mounted on recent automobiles has been increasing, which has increased the total power consumption. The increased power consumption and attendant increase in harness length and weight have made it difficult to reduce vehicle fuel consumption. Although the power consumption of discharge bulbs using an arc tube as a light source (about 35 W) is lower than that of halogen lamps (about 60 W), it is still higher than most automobile electric parts and accessories. Therefore, there is a need to reduce power consumption of discharge bulbs.

To address the foregoing need to save power in a discharge bulb having the structure of JPA 2002-243489, applicants tested a reduction in electric current supplied to the arc tube from its rated value to decrease the ordinary power consumption during steady lighting from 35 W to 25 W. As a result, the tube voltage decreased from 42 V to 40 V, the tube current decreased from 0.830 A to 0.600 A, the luminous flux decreased from 3200 lm to 2000 lm, and the luminous efficiency decreased from 91 lm/W to 80 lm/W. The chromaticity also decreased.

Accordingly, applicants obtained the following conclusions with respect to applicants' related art. First, a reduction in power consumption in a steady lighting mode reduces luminous flux, which in turn reduces luminous efficiency. As a result, the brightness of the lighting area is reduced.

Second, because a slight reduction in tube voltage results in a significant reduction in tube current, the electrode temperature drops. Thus, the required re-ignition voltage increases, and causes lamp flickering.

Third, the bulb emits bluish light due to the chromaticity change from x: 0.380 and y: 0.390, to x: 0.365 and y: 0.375.

As a result, there exists a need in the related art to overcome at least the foregoing problems and disadvantages.

SUMMARY OF THE INVENTION

The present invention overcomes at least the foregoing related art problems and disadvantages, and meets at least the foregoing unmet needs. More specifically, the size of the closed glass bulb has been reduced to make the discharge space smaller, and the distance between opposing electrodes has been shortened. As a result, the foregoing related art problems have been addressed.

An object of the present invention is to provide a mercury-free arc tube for a discharge lamp unit that produces a discharge in a stable manner at a low power.

The above object of the invention is accomplished by a mercury-free arc tube for a discharge lamp unit, comprising a spheroidal closed glass bulb, a pinch seal on each end of the closed glass bulb, and opposing electrodes disposed in the glass bulb, the glass bulb being filled with at least a primary light-emitting metal halide and a starting rare gas, and optionally a buffer metal halide, with the pressure of the starting rare gas being about 8 to 20 atm, wherein the inner diameter of the glass bulb at the middle between the opposing electrodes is about 1.5 to 2.7 mm, the distance between the opposing electrodes is about 1.0 to 4.0 mm, the length of each of the electrodes extending into the glass bulb is about 0.3 to 1.8 mm, and a stable discharge is produced with a power of about 15 to 30 W.

In the present invention the closed glass bulb is charged with a starting rare gas at a pressure of about 8 to 20 atm, which is substantially higher than the related art mercury-containing arc tubes (3 to 6 atm). As a result, the ratio at which electrons released from the electrodes in a discharge collide with rare gas molecules increases to raise the temperature inside the glass bulb during operation. Accordingly, the vapor pressure of the primary light-emitting metal halide (and optionally the buffer metal halide) is increased to increase the luminous flux and the tube voltage.

The closed glass bulb used in the invention has a substantially smaller inner axial length than related art arc tubes with a distance between electrode tips being about 1.0 to 4.0 mm (smaller than 4.2 mm according to the ECE (Economic Commission for Europe) specifications) and the length of the electrodes extending into the glass bulb being about 0.3 to 1.8 mm (smaller than 1.0 to 2.0 mm in related art glass bulbs). Additionally, the inner diameter of the glass bulb at the middle between the opposing electrodes is about 1.5 to 2.7 mm, which is substantially smaller than the maximum inner diameter of related art glass bulbs. Thus, the glass bulb has a smaller capacity.

Although the tube voltage somewhat decreases, heat dissipation from the glass bulb reduces to increase the vapor pressure of the primary light-emitting metal halide (and optinoally the buffer metal halide) in the bulb. Thus, the luminous flux and the luminous efficiency are improved. Although the power supplied to the arc tube is lower than 35 W, the arc tube achieves substantially equal luminous efficiency to that obtained with 35 W. As a result, the related art problem associated with reduced luminous efficiency is addressed.

Since heat dissipation from the glass bulb is reduced, the high electrode temperature in operation (in a discharge) is maintained. Thus, the required re-ignition voltage does not increase, and the related art flickering related art problem is reduced.

With the distance between the electrode tips being about 1.0 to 4.0 mm (smaller than the ECE specifications), the length of the electrodes extending into the bulb is about 0.3 to 1.8 mm (smaller than 1.0 to 2.0 mm as adopted in related art glass bulbs). By this configuration, the primary light-emitting metal halide (e.g., NaI or $ScI_3$) does not condense on the foot of the electrodes, and luminous efficiency is improved.

The related art problem of chromaticity deviating from the white region due to power reduction is solved by properly limiting the total amount of the primary light-emitting metal halide and the buffer metal halide sealed into the glass bulb. The mercury-free arc tube can thus be designed to emit light of substantially equal chromaticity to related art mercury-containing arc tubes or applicants' related art mercury-free arc tubes.

When the glass bulb is not charged with the buffer metal halide, the mercury-free arc tube of the invention performs as related art mercury-containing arc tubes or the applicants' related art mercury-free arc tubes, by properly adjusting the total amount or proportion of a prescribed primary light-emitting metal halide and the pressure of the starting rare gas (about 8 to 20 atm) in the closed glass bulb.

In an exemplary, non-limiting embodiment of the mercury-free arc tube of the present invention, the primary light-emitting metal halide is of an Na halide, an Sc halide, and a Dy halide. The buffer metal halide is at least one of an Al halide, a Cs halide, an Ho halide, an In halide, a Tl halide, a Tm halide, and a Zn halide. Also, the total amount of the metal halides in the glass bulb is about 10 to 30 mg/ml, and the ratio of the buffer metal halide to the total amount of the metal halides is about 0 to 50% by weight.

The preferred buffer metal halides include one or more of an Al halide, a Cs halide, an Ho halide, an In halide, a Tl halide, a Tm halide, and a Zn halide. The starting rare gas includes Xe. However, the present invention is not limited thereto, and corresponding equivalents having the necessary properties may be used.

As stated above, even without a buffer metal halide, it is possible to increase the tube voltage and to suppress reductions in chromaticity and luminous flux by adjusting the amount or ratio of the main light-emitting metal halide and the partial pressure of the starting rare gas. Nevertheless, a buffer metal halide is preferred (but not required) for an enhanced increase of the tube voltage and more effective compensation for the reduction of chromaticity in the visible region.

In detail, since the bulb has a high starting rare gas pressure (about 8 to 20 atm), an elevated temperature is reached inside the bulb in a discharge, and an increase in vapor pressure of the buffer metal halide results. The buffer metal halide emits light having effectively increased intensity at various wavelengths, and the deviation in chromaticity due to power reduction is corrected. Thus, the mercury-free arc tube containing both the primary light-emitting metal halide and the buffer metal halide emits light with substantially the same whiteness as obtained by related art mercury-containing arc tubes and applicants' related art mercury-free arc tubes.

When the total amount of the metal halides is less than about 10 mg/ml, the arc tube fails to have a sufficiently increased tube voltage and luminous flux. Life performance, such as a lumen maintenance factor, is also deteriorated. However, when the total amount of the metal halides is more than about 30 mg/ml, excess metal halides maybe deposited in a liquid state in the bottom of the bulb, and light transmitted therethrough can cause color unevenness or glare.

When the ratio of the buffer metal halide to the total amount of the metal halides exceeds about 50% by weight, the intensity of light emitted from the buffer metal halide increases with a decrease in intensity of light from the primary light-emitting metal halide, which results in a reduction of luminous flux, a deviation from a desired chromaticity range, and a reduction of color rendering. Therefore, the total amount of the metal halides should be from 10 to 30 mg/ml and the ratio of the buffer metal halide to the total metal halide content be from about 0 to 50% by weight.

In another exemplary, non-limiting embodiment of the arc tube of the invention, the ratio of the inner diameter D2 of the glass bulb at the tips of the opposing electrodes extending into the glass bulb, to the inner diameter D1 of the glass bulb at the middle between the opposing electrodes (D2/D1) is about 0.5 to 1.0, more particularly about 0.7 to 0.9.

Applicants' experiments have revealed that the ratio D2/D1 influences the shape of an arc, the discharge stability, a devitrification phenomenon, and the re-ignition voltage. Thus, D2/D1 is about 0.4 to 1.1 for optimization of the arc shape (straightness of the arc), about 0.5 to 1.0 for the discharge stability (a stable discharge with no flickering), about 0.5 to 1.2 for averting devitrification of the glass bulb, and about 0.5 or higher for optimization of the re-ignition voltage. To satisfy these requirements for a proper arc shape, discharge stability, avoidance of devitrification and a proper re-ignition voltage, the D2/D1 preferably ranges from about 0.5 to 1.0, more particularly about 0.7 to 0.9.

In still another exemplary, non-limiting embodiment of the present invention, the ratio of an applied tube current I (unit: A) to the outer diameter d (unit: mm) of the electrodes extending into the glass bulb (I/d) is about 1.0 to 4.0 (A/mm).

The electrode temperature T (° C.) is proportional to the current density and the electrode surface area, and is represented by the following equation as long as an electrode rod has a uniform thickness:

$$T=k_1(4I/\pi d^2)\pi dL=k_1LI/d,$$

where T is an electrode temperature (° C.); $k_1$ is a proportionality factor; I is a tube current (A); d is the outer diameter of an electrode (mm); and L is the length of an electrode extending into the inside of the closed glass bulb.

In other words, with the length L of an electrode extending into the glass bulb fixed, the electrode temperature T is decided by the ratio of the tube current I to the outer diameter d of the electrode rod (A/mm).

When the electrode temperature is too low, the re-ignition voltage increases, which can cause flickering. On the other hand, when the electrode temperature is too high, various problems occur, such as thermal deformation of the electrodes, blackening of the glass bulb at the foot of the electrodes due to sputtering of the electrode surface, and chemical reaction between tungsten (electrode material) and the enclosed substances (halogen compounds) on the electrode surface which results in deformation of the electrodes and reduction in lumen maintenance factor (life performance). Further, exhaustion of the electrodes can result in extinction of an arc, and the glass can crack due to the difference between the electrode material in the thermal expansion coefficient.

By adjusting the I/d ratio between about 1.0 to 4.0 (A/mm), the electrode temperature is maintained within a moderate range thereby to avert the flickering problem attributed to a low electrode temperature as well as the problems caused by a high electrode temperature, such as blackening of the glass bulb, reduction in lumen maintenance factor, extinction of an arc, and cracking of the glass.

In yet another exemplary, non-limiting embodiment of the invention, the arc tube is a shrouded arc tube. In this embodiment, a cylindrical glass shroud is integrally welded to the arc tube to provide a closed space in which the glass bulb is enclosed, the closed space being filled with an inert gas at a pressure of 1 atm or lower.

According to this embodiment, because the inert gas filling the closed space surrounding the glass bulb has a low molecular density, heat conduction from the glass bulb to the glass shroud via the closed space is controlled so that the heat in the closed glass bulb is substantially not dissipated. Thus, the inner temperature of the glass bulb may be kept high, which is beneficial for the primary light-emitting metal halide (and in some cases, for the buffer metal halide) and the starting rare gas to keep high vapor pressure, securing a high-luminous flux and a high tube voltage. The luminous efficiency is improved further to contribute to settlement of the above-described luminous efficiency problem.

DETAILED DESCRIPTION OF THE INVENTION

Figure 1:
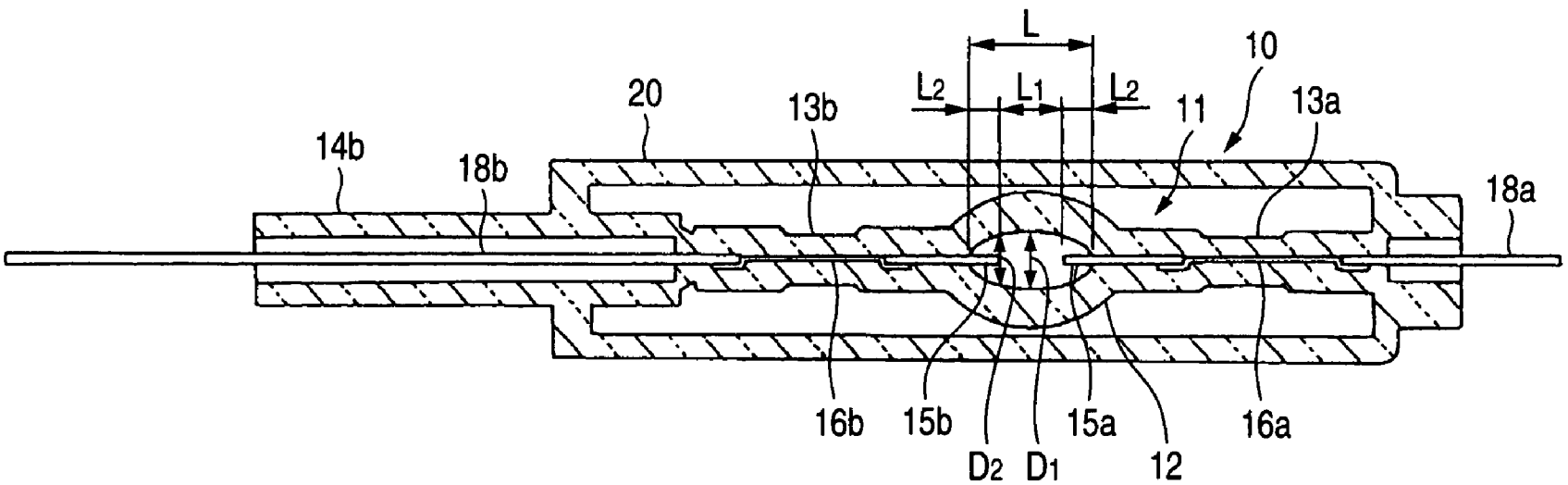
FIG. 1 is a longitudinal cross-section of a mercury-free arc tube according to an exemplary, non-limiting embodiment of the present invention.

An exemplary, non-limiting embodiment of the present invention will further be described by way of FIG. 1 showing a longitudinal cross-section of a mercury-free arc tube according to an exemplary, non-limiting embodiment of the present invention.

The mercury-free arc tube 10 includes an arc tube main body 11 and a UV-shielding cylindrical glass shroud 20 integrally welded and completely enclosing the main body 11. The arc tube main body 11 has a closed glass bulb 12, into which ends of a pair of electrodes 15*a*, 15*b* extend and face each other.

The arc tube main body 11 is made of a quartz glass tube having a circular cross-section. The closed glass bulb 12 is spheroidal in shape, and pinch seals 13*a* and 13*b* having a rectangular cross-section are formed on both sides of the glass bulb 12. Rectangular molybdenum foils l6*a*, 16*b* are pinch-sealed into the respective pinch seals 13*a*, 13*b*. One end of each of the molybdenum foils 16*a*, 16*b* is connected to respective tungsten electrodes 15*a*, 15*b*. The other end of each of the molybdenum foils 16*a*, 16*b* is connected to respective lead wires 18*a* and 18*b*, which extend from the arc tube main body 11.

The UV-shielding cylindrical glass shroud 20 has a larger inner diameter than the outer diameter of the closed glass bulb 12, and is welded to the arc tube main body 11, so that the glass bulb 12 and the pinch seals 13*a* and 13*b* are sealed into the glass shroud 20. The arc tube main body 11 has a tubular extension 14*b* (non-pinch sealed) having a circular cross-section that extends from the rear end of the glass shroud 20.

The glass shroud 20 is made of quartz glass doped with compounds such as $TiO_2$ and $CeO_2$ (but not limited thereto), has a UV shielding effect, and substantially reduces ultraviolet rays of wavelengths harmful to the human body out of the light emitted from the discharge glass bulb 12.

A primary light-emitting metal halide, a buffer metal halide, and xenon as a starting rare gas are sealed in the closed glass bulb 12. The partial pressure of the starting rare gas is about 8 to 20 atm, which enables the mercury-free arc tube 10 to exhibit substantially similar characteristics to the related art mercury-containing arc tubes.

The primary light-emitting metal halide, which primarily bears the function of light emission, is at least one compound selected from halides of Na, Sc, and Dy. The buffer metal halide is for controlling color to obtain desired light (white light), and buffering. The buffer metal halide is at least one compound selected from halides of Al, Cs, Ho, In, Tl, Tm, and Zn. The total amount of the metal halides (i.e., the primary light-emitting metal halide plus the buffer metal halide) is about 10 to 30 mg/ml, and the ratio of the buffer metal halide to the total amount of the metal halides is up to about 50% by weight.

When the total amount of the metal halides is less than about 10 mg/ml, sufficient tube voltage and luminous flux are not obtained, and life performance deteriorates. Alternatively, when the total amount of the metal halides exceeds about 30 mg/ml, excess metal halides may be deposited in a liquid state in the bottom of the bulb, and light transmitted through the liquid deposit can cause color unevenness or glare.

If the ratio of the buffer metal halide to the total amount of the metal halides is higher than about 50% by weight, the intensity of light emitted from the buffer metal halide increases with a decrease in intensity of light from the primary light-emitting metal halide. This increase can reduce luminous flux, cause deviation from a desired chromaticity range, and reduce color rendering. To avoid the foregoing problems, the total amount of the metal halides ranges from about 10 to 30 mg/ml and the ratio of the buffer metal halide to the total metal halide content ranges from about 0 to 50% by weight.

The glass bulb 12 is charged with a starting rare gas at a pressure of about 8 to 20 atm, which is higher than related art mercury-containing arc tubes (3 to 6 atm). Therefore, the ratio at which electrons released from the electrodes in a discharge collide with rare gas molecules increases, thus raising the temperature inside the glass bulb 12 in operation (in a discharge). As a result, the vapor pressures of the primary light-emitting metal halide and the buffer metal halide increase to correspondingly increase the luminous flux and tube voltage.

The inner diameter of the glass bulb 12 at the middle between the opposing electrodes 15*a* and 15*b* is about 1.5 to 2.7 mm, the distance between the tips of the opposing electrodes 15*a*, 15*b* extending into the glass bulb 12 is about 1.0 to 4.0 mm, the length of each of the electrodes 15*a*, 15*b* extending inside the glass bulb 12 is about 0.3 to 1.8 mm. With such a structure, a stable discharge is produced with a low power of about 15 to 30 W.

The glass bulb 12 has a smaller inner axial length than related art arc tubes, with a distance between the tips of the electrode 15*a* and 15*b* being about 1.0 to 4.0 mm (smaller than 4.2 mm according to the ECE specifications). The length of the electrodes extending into the glass bulb 12 is about 0.3 to 1.8 mm (smaller than 1.0 to 2.0 mm in related art glass bulbs).

Additionally, the inner diameter of the glass bulb 12 at the middle between the opposing electrodes 15*a*, 15*b* is about 1.5 to 2.7 mm (smaller than the maximum inner diameter of conventional glass bulbs). Accordingly, the glass bulb 12 has a smaller capacity.

Although the tube voltage decreases, heat dissipation from the glass bulb 12 is reduced so as to increase the vapor pressures of the primary light-emitting metal halide and the buffer metal halide in the bulb. Thus, luminous flux and luminous efficiency are improved. Even though the power supplied to the arc tube is about 15 to 30 W, which is lower than 35 W, the arc tube achieves substantially equal luminous efficiency to that reached with 35 W.

Because the distance between the tips of the electrodes 15*a*, 15*b* is about 1.0 to 4.0 mm (smaller than the ECE specifications) and the length of the electrodes extending inside the bulb 12 is about 0.3 to 1.8 mm (smaller than 1.0 to 2.0 mm as adopted in related art glass bulbs), the primary light-emitting metal halide (e.g., NaI or $ScI_3$) cannot condense on the foot of the electrodes 15*a*, 15*b*. As a result, the luminous efficiency is improved.

By specifying the amounts of the primary light-emitting metal halide and the buffer metal halide as disclosed above, the chromaticity of light emission during a low power operation in a range of 15 to 30 W would otherwise be tinged in blue (x: 0.365; y: 0.375). However, this problem is corrected to substantially the same level of the light emitted from related art mercury-containing arc tubes and applicants' related art mercury-free arc tubes.

The closed space defined by the glass bulb 12 and the glass shroud 20 is charged with an inert gas at a pressure of about 1 atm or less, so that the space functions as an insulator against heat radiated from the glass bulb 12.

The inert gas filling the closed space surrounding the glass bulb 12 has a low molecular density. Therefore, heat conduction from the glass bulb 12 to the glass shroud 20 via the closed space is controlled so that the heat in the closed glass bulb 12 is substantially trapped. Thus, the high inner temperature of the glass bulb 12 is maintained. As a result, the vapor pressures of the primary light-emitting metal halide, the buffer metal halide, and the starting rare gas increase to elevate the luminous flux and the tube voltage, and the luminous efficiency is further improved.

The ratio of the inner diameter D2 of the glass bulb 12 at the tips of the opposing electrodes 15*a*, 15*b* to the inner diameter D1 of the glass bulb 12 in the middle between the opposing electrodes 15*a* and 15*b* (D2/D1) is about 0.5 to 1.0. This ratio satisfies all the requirements for a proper arc shape, discharge stability, avoidance of devitrification, and moderate re-ignition voltage.

Mercury-free arc tubes having various D2/D1 ratios (n=5) were prepared and tested to examine the relationship between the D2/D1 ratio and the arc shape, discharge stability, devitrification of the glass bulb, and the re-ignition voltage. The results obtained are summarized in Table 1 below. The number of satisfactory samples in each testing item out of 5 tests is shown. A, B, and C mean "satisfactory", "almost satisfactory", and "insufficient", respectively.

The mercury-free arc tubes tested were a first sample set in which the closed glass bulb 12 was filled with 0.3 mg of a 70:30 (by weight) mixture of NaI and $ScI_3$ as a primary light-emitting metal halide, 0.05 mg of $ZnI_2$ as a buffer metal halide, and 10 atm of xenon gas as a starting gas, and a second sample set in which the glass bulb 12 was filled with 0.1 mg of a 75:25 (by weight) mixture of NaI and $ScI_3$ as a primary light-emitting metal halide and 12 atm of xenon gas a starting gas.

TABLE 1

| | D2/D1 | | | | | | | | |
|---|---|---|---|---|---|---|---|---|---|
| | 0.4 | 0.5 | 0.6 | 0.7 | 0.8 | 0.9 | 1.0 | 1.1 | 1.2 |
| Arc Shape | 3/5 B | 5/5 A | 5/5 A | 5/5 A | 5/5 A | 5/5 A | 4/5 B | 3/5 B | 1/5 C |
| Discharge Stability | 1/5 C | 2/5 B | 5/5 A | 5/5 A | 5/5 A | 5/5 A | 3/5 B | 1/5 C | 1/5 C |
| Devitrification of Glass Bulb | 0/5 C | 2/5 B | 3/5 B | 5/5 A | 5/5 A | 5/5 A | 4/5 B | 2/5 B | 2/5 B |
| Re-ignition Voltage | 0/5 C | 2/5 B | 5/5 A | 5/5 A | 5/5 A | 5/5 A | 5/5 A | 4/5 B | 2/5 B |

Table 1 shows that D2/D1 affects the arc shape, discharge stability, devitrification of the glass bulb, and re-ignition voltage. More specifically, for arc shape, the arc has a large curvature at a D2/D1 smaller than 0.4, or the longitudinal middle portion of the arc is caved inward at a D2/D1 of 1.2 or greater. In either case, it is difficult to control the distribution of luminous intensity because of lack of straightness of the arc. From the viewpoint of arc shape, the D2/D1 is preferably in a range of from 0.4 to 1.1, more preferably from 0.5 to 0.9.

With respect to discharge stability, when D2/D1 is 0.4 or smaller, the wall of the glass bulb is too close to the electrodes to sufficiently raise the temperature of the electrodes. As a result, the arc flickers. At a D2/D1 of 1.1 or greater, the longitudinal middle portion of the art contacts the bulb wall, also resulting in flickering. From this standpoint, the D2/D1 is preferably in a range of from 0.5 to 1.0, more preferably from 0.6 to 0.9.

With reference to devitrification of the glass bulb, where the D2/D1 is smaller than 0.4, scandium (Sc) reacts with the glass to whiten the bulb wall, and the light transmission of the bulb is reduced. Therefore, the D2/D1 is preferably 0.5 or greater, more preferably 0.7 to 0.9, for avoiding devitrification of the glass bulb.

As for the re-ignition voltage, when the D2/D1 is 0.4 or smaller, the bulb wall is so close to the electrodes that the electrode temperature drops on switching the polarity. As a result, a higher re-ignition voltage is needed, which causes flickering. Hence, the D2/D1 is preferably at least 0.5, and more preferably 0.6 to 1.0.

Thus, for the arc tube to satisfy the foregoing requirements regarding arc shape, discharge stability, avoidance of devitrification of glass, and re-ignition voltage, the D2/D1 should range from 0.5 to 1.0, particularly 0.7 to 0.9.

When the temperature of the electrodes 15*a*, 15*b* is too low, the re-ignition voltage decreases, which can cause flickering. On the other hand, if the electrode temperature is too high, unfavorable phenomena can occur, such as cracking of the glass, extinction of the arc due to exhaustion of the electrodes, thermal deformation of the electrodes, blackening of the glass bulb near the foot of the electrodes due to sputtering of the electrode surface, chemical reaction between tungsten electrodes and halogen gas to deform the electrodes, which results in reduction of average lumen maintenance factor.

Therefore, in the exemplary, non-limiting embodiment of the present invention, the temperature of the electrodes 15*a*, 15*b* is maintained within a moderate range by adjusting the ratio of tube current I to outer diameter d of the electrode rods 15*a*, 15*b*, i.e., I/d (A/mm) within a range of about 1.0 to 4.0, particularly about 2.0 to 3.5.

As previously stated, the electrode temperature T (° C.) is proportional to the current density and the electrode surface area as represented by the following equation:

$$T=k_1(4I/\pi d^2)\pi dL=k_1LI/d,$$

where the symbols are as defined above. Thus, the electrode temperature T is decided by the ratio of the tube current I to the outer diameter d of the electrode rod (A/mm), provided that the length L of an electrode extending inside the glass bulb is fixed.

To confirm the influence of the I/d ratio on arc tube performance, the inventors tested the same sets f the first and second samples as used in the above-described test while varying the I/d ratio. After test arc tubes (n=5) were put into operation in an EU car maker flashing mode for 1500 consecutive hours, the number of arc tubes which suffered from (1) cracking in the pinch seals 13*a*, 13*b*, (2) flickering, (3) electrode deformation or (4) blackening of glass bulb was counted, and an average lumen maintenance factor (LMF; %) was calculated. The results are shown in Table 2, in which A, B, and C have the same meanings as in Table 1.

TABLE 2

| | I/d (A/mm) | | | | | | | | | |
|---|---|---|---|---|---|---|---|---|---|---|
| | 0.5 | 1.0 | 1.5 | 2.0 | 2.5 | 3.0 | 3.5 | 4.0 | 4.5 | 5.0 |
| Cracking of Glass | 0/5 A | 0/5 A | 0/5 A | 0/5 A | 0/5 A | 0/5 A | 0/5 A | 0/5 A | 2/5 B | 4/5 B |
| Flickering | 5/5 C | 3/5 B | 2/5 B | 0/5 A | 0/5 A | 0/5 A | 0/5 A | 0/5 A | 0/5 A | 0/5 A |
| Electrode Deformation | 0/5 A | 0/5 A | 0/5 A | 0/5 A | 0/5 A | 0/5 A | 0/5 A | 1/5 B | 4/5 B | 5/5 C |
| Bulb Blackening | 0/5 A | 0/5 A | 0/5 A | 0/5 A | 0/5 A | 0/5 A | 0/5 A | 2/5 B | 2/5 B | 5/5 C |
| LMF (%) | 76 A | 75 A | 75 A | 73 A | 75 A | 74 A | 71 A | 70 A | 68 C | 65 C |

As shown in Table 2, flickering was not observed with any of the test arc tubes having an I/d of 2.0 to 5.0. Flickering occurred in some arc tubes having an I/d of 1.5 or smaller, and in all the arc tubes having an I/d of 0.5 or smaller. None of the arc tubes having an I/d of 0.5 to 4.0 developed a crack in the pinch seals, while some of the arc tubes having an I/d of 4.5 or greater developed a crack.

Electrode deformation was not observed in all the arc tubes having an I/d ranging 0.5 to 3.5, while some of the arc tubes having an I/d of 4.0 or greater suffered from electrode deformation. All of the arc tubes having an l/d of 5.0 or greater experienced electrode deformation.

All arc tubes having an l/d ranging from 0.5 to 3.5 did not experience bulb blackening. Some arc tubes having an l/d of 4.0 suffered from bulb blackening, while those arc tubes having an l/d of 5.0 or greater showed bulb blackening.

The arc tubes having an l/d of 0.5 to 4.0 had an average lumen maintenance factor of 70% or more. Those with an l/d of 4.5 or greater had an average lumen maintenance factor as low as below 70%.

These observations show that problems such as flickering, crack development in pinch seals, electrode deformation, blackening of a glass bulb, and reduction in lumen maintenance factor, can be averted by adjusting the l/d ratio in a range from about 1.0 to 4.0, particularly about 2.0 to 3.5.

Figure 2:
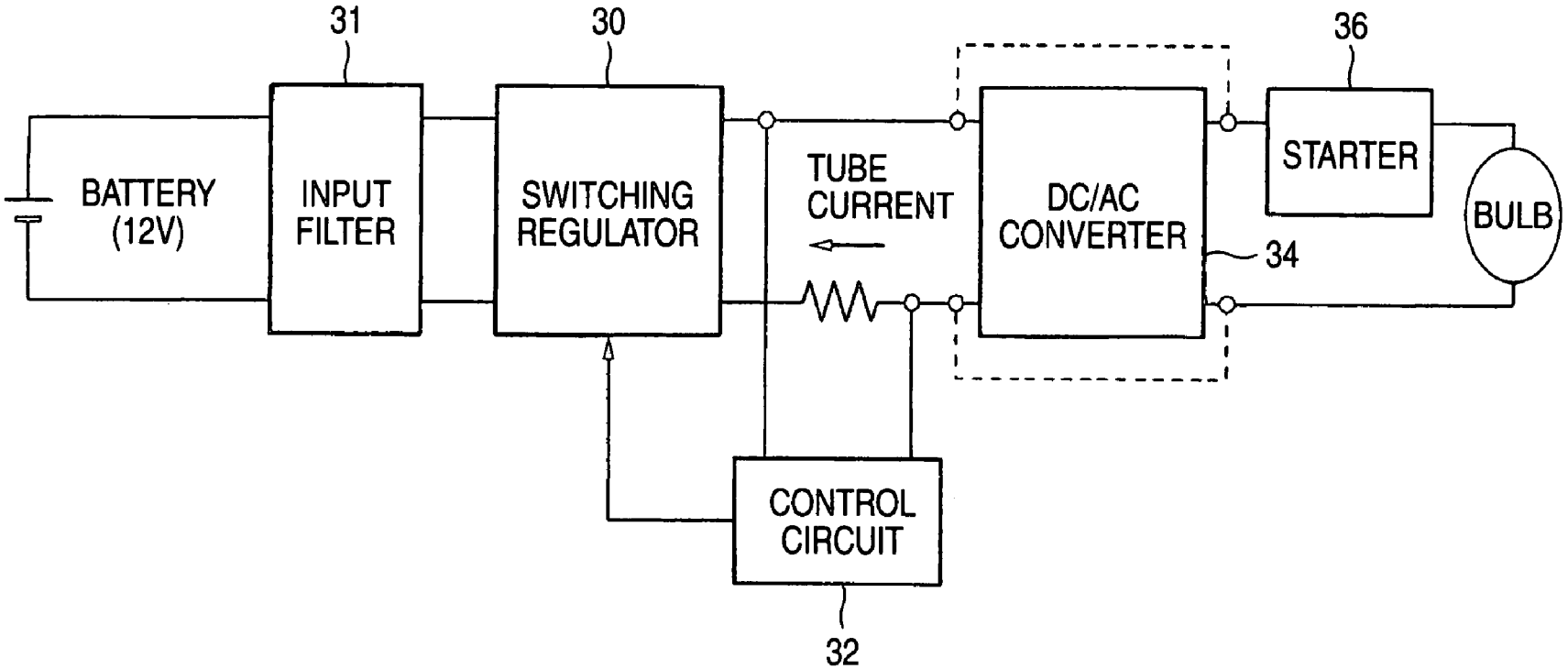
FIG. 2 is a block diagram of a lighting circuit for lighting a discharge bulb according to an exemplary, non-limiting embodiment of the present invention.
Figure 3:
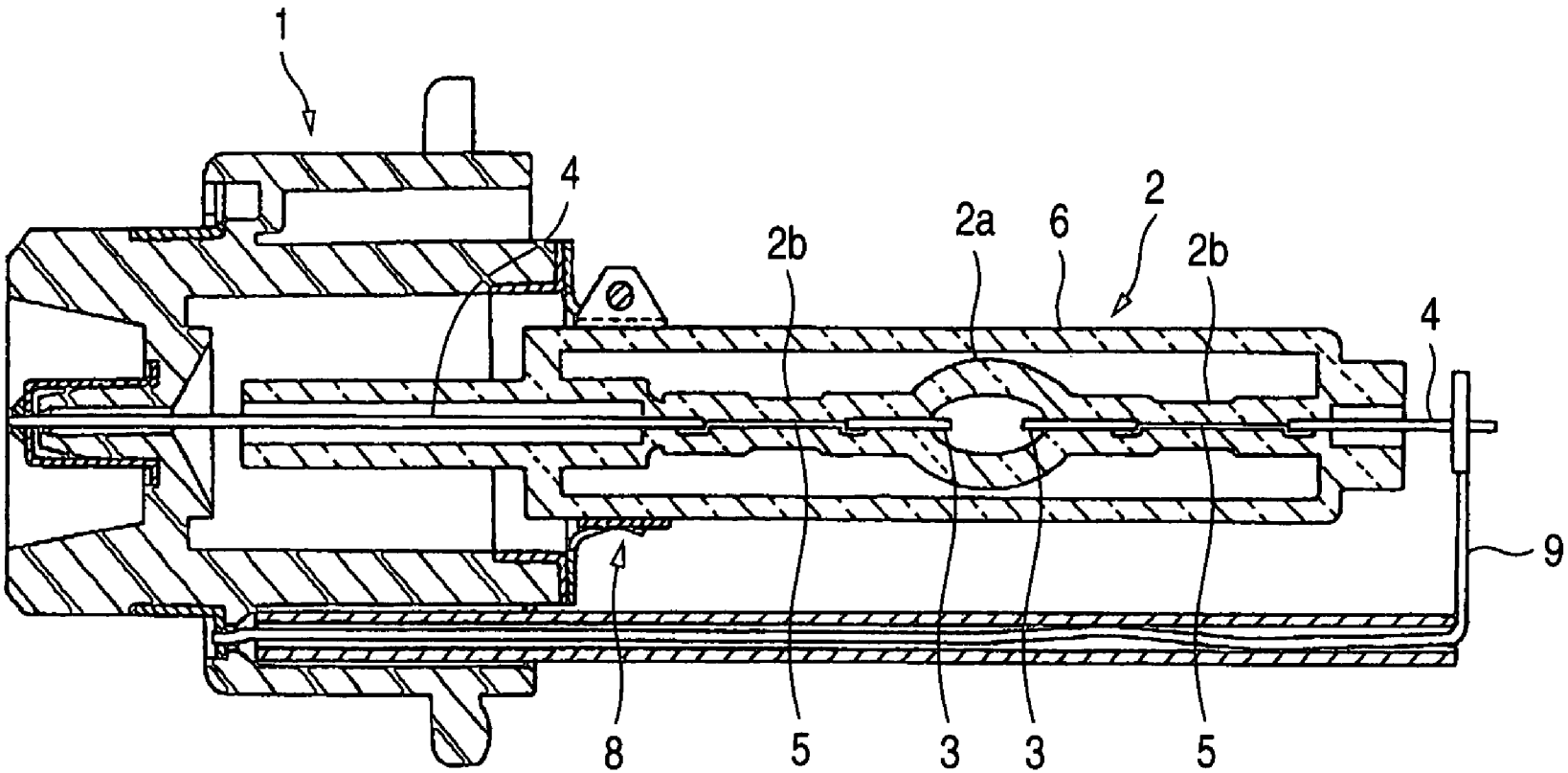
FIG. 3 is a longitudinal cross-section of a related art discharge lamp unit.

FIG. 2 is a block diagram showing an AC lighting circuit for lighting the discharge bulb having an arc tube according to an exemplary, non-limiting embodiment of the present invention. The lighting circuit includes a switching regulator 30 for converting a battery voltage to a tube voltage, a control circuit (CKT) 32 for detecting the tube voltage and tube current of the discharge bulb and controlling the output of the switching regulator 30 by a feed-back system to regulate the tube voltage of the discharge bulb, a DC/AC converter 34 for converting the output (DC) from the switching regulator 30 into AC (square wave), and a starter circuit 36. A filter circuit (CKT) 31 removes noise from the current output to the switching regulator 30.

According to the AC lighting system shown in FIG. 2, since an electric current is supplied alternately to the pair of electrodes (a positive voltage alternates between the two electrodes), the distribution of positive ions of a metal (e.g., Na or Sc) in the closed glass bulb is symmetric about the longitudinal axis of the bulb. Therefore, the arc tube operated in this system emits light having a symmetric and uniform color appearance.

When operated in the AC lighting system shown in FIG. 2, the above-described first and second samples showed a tube voltage of 40 V, a luminous flux of 2100 lm, a luminous efficiency of 85 lm/W, and a chromaticity of (x: 0.380; y: 0.385). Those characteristics are substantially close to applicants' related art mercury-free arc tubes operated at 35 W (Japanese Patent Application No. 2002-243489), except for the luminous flux.

The present invention has various advantages over the related art. For example, but not by way of limitation, the mercury-free arc tube of the present invention has a smaller glass bulb capacity and a shorter electrode-to-electrode distance than the known mercury-free arc tubes. Therefore, even when it is operated in a DC lighting system, the metal (e.g., Na or Sc) positive ions are distributed in the glass bulb almost uniformly without being localized around the negative electrode. Thus, a favorable luminous intensity distribution with reduced color separation as a front headlight is formed.

Where the mercury-free arc tube of the invention is operated in a DC lighting system, a lighting circuit can be used having the same configuration as FIG. 2, except that the paths indicated by broken lines are used in place of the DC/AC converter 34. According to the DC lighting system in which an electric current is always supplied in one direction, because the metal ion distribution differs between the vicinities of the positive and the negative electrodes, the lighting color is less symmetric (and prone to separation). Thus, the DC lighting system is generally difficult to use.

Nevertheless, the mercury-free arc tube of the present invention can be used as a front headlight in a DC lighting system with no practical problem. As a result, there is a smaller glass bulb capacity and a shorter electrode-to-electrode distance than the related art mercury-free arc tubes. The mercury-free arc tube of the invention achieves an almost uniform distribution of the metal (e.g., Na or Sc) positive ions in the glass bulb without localization around the negative electrode. A favorable luminous intensity distribution can then be obtained with reduced color separation.

Thus, the discharge bulb having the mercury-free arc tube of the present invention is advantageous in that it is applicable to a DC or AC lighting system.

The present invention provides a mercury-free arc tube which produces a stable discharge with a low power of 15 to 30 W to provide adequate brightness in a lighting area. According to the invention, such a mercury-free arc tube can be provided by a closed glass bulb with a smaller capacity and a shorter distance between the electrodes, and a glass bulb filled with a primary light-emitting metal halide and a starting rare gas as essential components and a buffer metal halide as an optional component. The partial pressure of the starting rare gas in the glass bulb is about 8 to 20 atm, which is higher than in related art mercury-containing arc tubes.

The present invention also provides, in its first exemplary, non-limiting embodiment, a mercury-free arc tube which produces a stable discharge with a lower power (15 to 30 W) than related art mercury-containing or mercury-free arc tubes to provide a luminous flux of 1500 to 3000 lm.

The present invention also provides, in its second exemplary, non-limiting embodiment, a mercury-free arc tube of which the closed glass bulb has a specific inner wall design to satisfy all the requirements relating to the arc shape, stability of a discharge, avoidance of devitrification of the glass bulb, and the re-ignition voltage.

The present invention also provides, in its third exemplary, non-limiting embodiment, a mercury-free arc tube of which the electrodes are maintained at an appropriate temperature. The arc tube of this embodiment is freed of related art problems such as flickering, cracking in the glass, extinction of an arc, deformation of the electrodes, blackening of the glass bulb, and reduction in average lumen maintenance factor.

The present invention also provides, in its fourth exemplary, non-limiting embodiment, a mercury-free arc tube for low power operation that exhibits an improved luminous flux and a higher luminous efficiency due to the heat insulating effect of the closed space (charged with an inert gas at or below atmospheric pressure) surrounding the closed glass bulb.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

We claim:

1. A mercury-free arc tube for a discharge lamp unit comprising:

a spheroidal closed glass bulb;

a pinch seal on each end of the closed glass bulb; and opposing electrodes disposed in the glass bulb, the glass bulb being filled with a primary light-emitting metal halide and a starting rare gas, a pressure of the starting rare gas being 8 to 20 atm, wherein an inner diameter of the glass bulb at a middle part between the opposing electrodes is 1.5 to 2.7 mm, a distance between the opposing electrodes is 1.0 to 4.0 mm, a length of each of the electrodes extending into the glass bulb is 0.3 to 1.8 mm, and a stable discharge is produced with a power of 15 to 30 W, wherein a ratio of an inner diameter D2 of the glass bulb at tips of the opposing electrodes to an inner diameter D1 of the glass bulb at the middle part between the opposing electrodes (D2/D1) is 0.5 to 1.0, and wherein a ratio of a tube current I (unit: A) supplied to the arc tube to the outer diameter d (unit: mm) of the electrodes sticking out inside the glass bulb (I/d) is 1.0 to 4.0 (A/mm).

2. A mercury-free arc tube according to claim 1, further comprising a buffer metal halide, wherein the primary light-emitting metal halide is at least one member selected from an Na halide, an Sc halide, and a Dy halide, the buffer metal halide is at least one member selected from an Al halide, a Cs halide, an Ho halide, an In halide, a Tl halide, a Tm halide, and a Zn halide, the total amount of the metal halides in the glass bulb is 10 to 30 mg/ml, and the ratio of the buffer metal halide to the total amount of the metal halides is 0 to 50% by weight.

3. A mercury-free arc tube according to claim 1, further comprising a cylindrical glass shroud integrally welded to said arc tube to provide a closed space enclosing the glass bulb, the closed space being filled with an inert gas at a pressure of 1 atm or lower.

* * * * *